US005463440A

United States Patent [19]

Panontin et al.

[11] Patent Number: 5,463,440

[45] Date of Patent: Oct. 31, 1995

[54] PHOTOGRAPHIC MATERIAL ADVANCEMENT ADAPTATION UNIT FOR PLANT FOR CONTINUOUS DEVELOPMENT OF PHOTOGRAPHIC MATERIAL

[75] Inventors: Renzo Panontin; Ivo Del Ben, both of Azzano, Italy

[73] Assignee: G.P.E. S.R.L., Azzano Decimo, Italy

[21] Appl. No.: 166,039

[22] Filed: Dec. 14, 1993

[30] Foreign Application Priority Data

Dec. 14, 1992 [IT] Italy ..... BL92A0016

[51] Int. Cl.[6] ..... G03D 3/08; G03D 13/00

[52] U.S. Cl. ..... 354/298; 354/319; 354/321

[58] Field of Search ..... 354/297, 298, 354/319–324, 339, 340; 355/27–29; 364/468, 474.11, 526

[56] References Cited

U.S. PATENT DOCUMENTS

| | | | |
|---|---|---|---|
| 4,272,185 | 6/1981 | Arai et al. | 355/28 |
| 4,618,251 | 10/1986 | Yanagawa et al. | 355/28 |
| 4,782,354 | 11/1988 | Gregoris | 354/322 |
| 4,930,672 | 6/1990 | Renzo | 226/119 |
| 5,153,839 | 10/1992 | Cross | 364/468 |
| 5,185,866 | 2/1993 | Franciso | 364/474.11 X |

*Primary Examiner*—D. Rutledge
*Attorney, Agent, or Firm*—Horst M. Kasper

[57] ABSTRACT

On a plant for continuous development of photographic material, comprising a plurality of operative units (6, 7, 8, 9, 10) for the photographic material treatment, there are provided a first and a second autonomous and independent adaptation units (12, 15), which can be interposed removably among these operative units so as to compensate the different photographic material advancement speeds between the one and the other unit, by controlling suitably the photographic material advancement devices of each adaptation unit and the operative units adjacent thereto. Advantages of the invention system include that the dangers of damagings and/or breakages of the photographic material are avoided during the advancement thereof among the various plant operating units and adaptation units, while promoting a rational and reliable arrangement and operation of the same plant.

19 Claims, 4 Drawing Sheets

PHOTOGRAPHIC MATERIAL ADVANCEMENT ADAPTATION UNIT FOR PLANT FOR CONTINUOUS DEVELOPMENT OF PHOTOGRAPHIC MATERIAL

BACKGROUND OF THE INVENTION

1. Field of the Invention

The present invention relates to operative units for a plant for continuous development of photographic material, such as film or paper, and in particular for an adaptation of the advancement speed of such photographic material among the different component elements of such a development plant.

2. Brief Description of the Background of the Invention Including Prior Art

A plant for the automatic and continuous photographic development of photographic material like film and paper, comprising substantially a plurality of different, per se known operative units, such as for example photographic film developing machines, labelling machines, printing machines, which can be combined with each other at variable sequences depending on the needs of the different customers, to achieve an automatic and continuous development of such photographic material is disclosed in the U.S. Pat. No. 4,782,354. This plant is in particular provided with one or more photographic material storage units interposed between the one and the other one of the above mentioned operative units. Each material storage unit includes a set of rotating rollers applied on the upper side of the associated units and having stationary rotation axis. Each material storage unit also includes a set of rotating rollers applied on the lower side of such unit and having rotation axis which are either stationary or displaceable with respect to the upper roller axis. As a result, the photographic material is wound around the respective upper and lower rollers and there is caused a continuous advancement of the photographic material from the One operative unit to the other one during the operation of the plant. Therefore, these storage units, in addition to providing the photographic material advancement, allow also the immediate storage of the photographic material at a variable rate onto such upper and lower rollers, thereby compensating the unavoidable changes of the advancement speeds of the photographic material leaving the directly preceding operative units, in order that the photographic material leaving such storage units may arrive with a predetermined advancement speed at the respective subsequent plant operative unit.

Finally, all the operative and storage units of the such formed plant are connected to one or more data processors. The data processors control the carrying out of the relevant predetermined operative sequences of the operative and storage units to provide for the advancement of the photographic material through all the units, so as to obtain the development and printing of the same material.

A photographic material storage unit is known from the U.S. Pat. No. 4,930,672, which is used in connection with the photographic material developing and printing plant taught in the U.S. Pat. No. 4,782,354. The photographic material storage unit of the U.S. Pat. No. 4,930,672 is substantially identical to the storage units of the plant described in U.S. Pat. No. 4,782,354 and is provided with further sets of upper and lower rotating rollers. These latter rollers have rotation axles displaceable with respect to the axles of the upper rollers. Said rollers are situated at the inlet and outlet side of each storage unit to permit the removable connection of each storage unit with the adjacent plant operative-units. This provides for the advancement of the photographic material through all the units in order to obtain the development and printing of the same material. However, the such formed plant has different inconveniences. First of all, each storage unit exhibits considerable overall dimensions and always includes a compensation mechanism of the photographic material forward speeds, comprising the upper and lower rotating rollers. The storage units are incorporated into an actual photographic material storage warehouse. This results in a complicated construction and requires the availability of considerable spaces for the installation of the storage units together with the different plant operative units.

Besides, such storage unit needs always a certain response time, even if of limited duration, for the compensation of the different photographic material feed speeds between the outlet side of the one operative unit disposed directly upstream and downstream in the same storage unit. This is a result of the unavoidable inertia of the compensation mechanism forming said storage unit. In the case in which the storage unit is spaced away relative to an associated operative unit adjacent thereto, this circumstance might involve undesired changes of the sliding path of the photographic material between such adjacent units, resulting in the hazard of distortions and/or possible breaking of such material. Finally, all the operative and storage units of the plant referred to are controlled in an interdependent manner by the central processing computer unit, such that a possible operative failure or defect in any one of these units may involve an undesired operation such as stopping of the entire plant.

SUMMARY OF THE INVENTION

1. Purposes of the Invention

It is an object of the present invention to provide for particular adaptation units which are installed disposed in each case between the two operative units so as to allow a correct advancement of the photographic material through the operative units of the plant.

It is another object of the invention to make the operation of advancement of the photographic material flexible and very reliable.

It is yet another object to furnish the possibility to combine same operative units thereamong also in a different way the, depending on the needs of the single customers.

It is a further object of the present invention to provide for a variable disposition and combination of the operative units and thereby to allow for a flexible construction of a development plant for photographic material adapted to the needs of the user.

These and other objects and advantages of the present invention will become evident from the description which follows.

2. Brief Description of the Invention

The present invention provides for a photographic material advancement adaptation unit for a plant for continuous development of photographic material to be disposed between a first operating unit and a second operating unit. Said adaptation unit comprises guide means shaped as rotating rollers for passing the photographic material and at least a driving band leader for entraining the photographic material therethrough. Temporary collecting means shaped as stationary upper rollers and movable lower rollers, for winding the photographic material thereon, are adapted to compensate the changes of advancement speed of the photographic material through different plant units, by means of a succession of storing and dispensing such photographic material between the one and the other one unit. At least a display unit of a conventional type is connected to the adaptation unit for controlling and inspecting the operation of said adaptation unit. A powered means is associated with said adaptation unit to provide for advancing the photographic material. Control means are connected to the adaptation unit for controlling the operation of the adaptation unit in accordance with preestablished operating cycles and depending on the operational state of the first operating unit and of the second operating unit disposed directly adjacent to the adaptation unit. First sensor means provided to said adaptation unit are adapted to sense as coded information the quantity of photographic material which is provided from time to time within said temporary collecting means. Said first sensor means is controlled by said control means associated with the adaptation unit in such a way as to influence a first powered means of the first operating unit preceding the adaptation unit and a second powered means of the second operating unit following to the adaptation unit in a way to change or stop a rotation of the powered means of the adaptation unit depending on the photographic material being provided within the adaptation unit.

The sensor means provided to said adaptation unit can be adapted to sense as coded information the quantity of photographic material which is provided from time to time within said temporary collecting means. Said sensor means can be controlled by said control means associated with the adaptation unit in such a way as to influence in a way to change and stop, respectively, a rotation of the powered means of the adaptation unit depending on the photographic material being provided within the adaptation unit.

The sensor means can further comprise a plurality of electronic, electric, electromechanical or similar sensors of a conventional type, connected operatively to said control means. The control means can be associated with the adaptation unit and adapted to sense a presence of the photographic material and to sense an absence of the photographic material along a sliding path of the adaptation unit, up to an upper and a lower position of an end of section thereof, which sensing furnishes a signal. The signal can be delivered through said display unit. The delivered signal can alert to conditions corresponding to anomalous operative conditions of said adaptation unit.

A dispensing roller and a winding roller for a driving band leader can be arranged removably and corresponding to the sliding path for the photographic material, to allow said driving band leader to pass from said dispensing roller to said winding roller and vice versa.

Said second adaptation unit can comprise clutch means of a conventional type, to keep the photographic material leaving the adaptation unit substantially steadily tensioned prior to an arrival of the photographic material on a subsequent operating unit. Final cutting means can be disposed between an outlet side of the adaptation unit and said clutch means for cutting the photographic material at appropriate intervals.

Said cutting means can comprise a first rectilinear arm fixed to said first adaptation unit. A second movable arm cooperating with said first fixed arm can be provided with at least a cutting element adapted to cut the photographic material. A third rectilinear arm can be provided at a first end of the third rectilinear arm with at least an idle rotating roller for sliding and guiding the photographic material, in case of scarcity of photographic material within said second adaptation unit. A fourth arm can be fixed with a first end of the fourth arm to said first arm. Said third arm can be articulated at its second end with the fourth arm. Said third arm can be joined to said fourth arm by spring means adapted to keep said third arm and said fourth arm pushed relative toward each other. The third arm can be provided at the second end with first driving means engaging second driving means provided on said second movable arm. Said third arm can be adapted to shift said second movable arm together with said cutting element, by means of said first driving means and said second driving means, from a first rest position in which said cutting element does not affect the photographic material passing through a correspondent through hole of said cutting element, to a second operating position in which said cutting element affects the photographic material, by cutting it, in presence of a scarce quantity of photographic material within said second adaptation unit.

These adaptation units are made with the constructive features substantially described, with particular reference to the attached patent claims.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
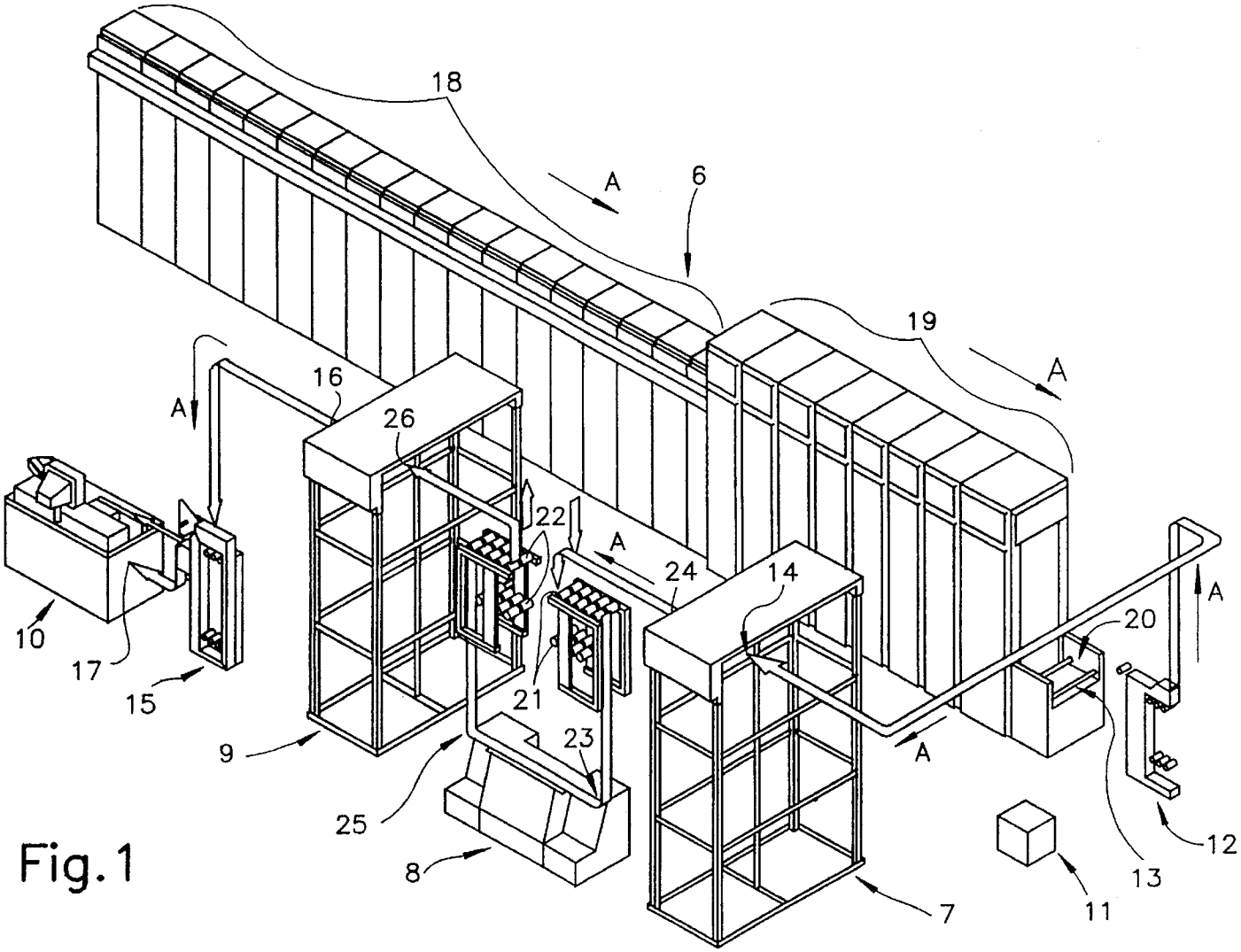
FIG. 1 is a schematic perspective view of a possible embodiment of a photographic material developing plant, incorporating the present adaptation units.

According to the present invention there is provided for a photographic material advancement adaptation unit for a plant for continuous development of photographic material. Said plant includes a plurality of operating units of a conventional type including a developing machine 6, collecting storage means 7, 9, a quality checking table 8, cutting equipment 10, etc. Said operating units can be combined to each other in different manners. The photographic material is passed through said operating units for its treatment. At least a display unit 11 of a conventional type controls and inspects the operation of said operating units 6; 7, 9; 8, 10 and said adaptation units 12, 15. Said operating units 6; 7, 9; 8, 10 and said adaptation units 12, 15 are provided with powered means 35; 56, 64 for advancing the photographic material and control means, such as a microprocessor, which are independent of each other, predisposed to control the operation of the respective units in accordance with preestablished operating cycles and depending on the operational state of the other operating units and adaptation units directly adjacent thereto. Said adaptation units 12, 15 comprise guide means 30, 31, 33, 35, 34; 51, 54, 53, shaped as rotating rollers for passing the photographic material and at least a driving band leader for entraining the photographic material therethrough. Said adaptation units 12, 15 further comprise temporary collecting means 27, 29; 45, 49 shaped as stationary upper rollers and movable lower rollers, for winding the photographic material thereon. Said temporary collecting means 27, 29; 45, 49 are adapted to compensate the changes of the photographic material advancement speed through the different plant units, by means of a succession of storages and dispensing of such photographic material between the one and the other one unit. At least a first and a second adaptation unit 12, 15 are disposed autonomous and separated as well as removably interposable between two operating units which are disposed consecutive to each other 6, 7; 9, 10. Said first and second adaptation units 12, 15 are provided with sensor means 44; 82, 83, adapted to sense as coded information the quantity of photographic material which is provided from time to time within said temporary collecting means 27, 29; 45, 49. Said sensor means 44; 82, 83 are controlled by said control means in such a way as to influence said powered means of the plant units respectively adjacent thereto, and in case also said powered means 35; 56, 64 of the adaptation units 12, 15, in a way to change or stop the rotation of the same powered means depending on the photographic material being provided within the respective adaptation unit.

Said sensor means 44; 82, 83 can comprise a plurality of electronic, electric, electromechanical or similar sensors of a conventional type, connected operatively to said control means and adapted to sense a presence of the photographic material or to sense an absence of the photographic material along its sliding path, up to an upper and a lower position of an end of section thereof. This sensing can result in a signal wherein the signal can be signalled through said display unit 11, and can correspond to anomalous operative conditions of said first and second adaptation units 12, 15.

Said first and second adaptation units 12, 15 can comprise respectively at least a dispensing roller 41 and a winding roller 78 for the driving band. The driving band can be arranged removably and corresponding to the sliding path for the photographic material, to allow said driving band to pass from the one to the other one of said dispensing roller 41 and said winding roller 78.

Said second adaptation unit 15 can comprise a clutch means 63 of a conventional type, to keep the tension of the photographic material leaving the same unit substantially steady, before the photographic material arrives on a subsequent operating unit. Said second adaptation unit 15 can further comprise cutting means 66, disposed between the unit outlet side 79 and said clutch means 63, for cutting the photographic material at appropriate intervals.

Said cutting means 66 can comprise a first rectilinear arm 67, fixed to said second adaptation unit 15, a second movable arm 69 cooperating with said first fixed arm 67 and provided with at least a cutting element 70 adapted to cut the photographic material. Said cutting means can further comprise a third rectilinear arm 74, provided at an end thereof with at least an idle rotating roller 77 for sliding and guiding the photographic material, in case of scarcity of photographic material, within said second adaptation unit 15. Said third arm 74 can be articulated at its other end with a fourth arm 75 fixed to said first arm 67, and joined to said fourth arm 75 by spring means 76 adapted to keep said arms 74, 75 pushed the one toward the other one. Said third arm 74 can also be provided at its other end with driving means 73 engaging correspondent driving means 72 provided on said second movable arm 69. Said third arm 74 can be adapted to shift said second movable arm 69 together with said cutting element 70, by means of said driving means 73, 72, from a first rest position in which said cutting element 70 cannot affect the photographic material passing through a corresponding through hole (71) thereof, to a second operating position in which said cutting element 70 can affect the photographic material, by cutting it, in presence of a scarce quantity of photographic material within said second adaptation unit 15.

FIG. 1 shows a possible embodiment of a plant for automatic continuous development of photographic material, i.e. paper and film, of the type of a continuous strip and, in particular, for a photographic paper. The plant substantially comprises a conventional developing machine 6, a first collecting storage means 7, a quality-control table 8, a second collecting storage means 9, a cutting equipment 10, formed for example by a common cutter or the like, and a display unit 11, and includes further the adaptation units according to the invention. A first adaptation unit 12 is placed between the outlet side 13 of the developing machine 6 and the inlet side 14 of the first collecting storage means 7. A second adaptation unit 15 is placed between the outlet side 16 of the second collecting storage means 9 and the inlet side 17 of the cutting equipment 10 and acts as a feeder device of the photographic material to the cutting equipment 10.

As usual, the developing machine 6, in particular for a development of the photographic paper, is provided with the different treatment tanks 18 containing the different chemical baths required for developing the photographic material introduced into the same machine. The construction of such baths for convenience is not elaborated here since such baths are of a conventional type and therefore known. The developing machine is further provided with drying units 19 for photographic material, for the complete drying of the developed photographic material. Again, the construction of such drying units 19 for photographic material is not describer in detail here, because such drying units can be of a conventional construction type. An end collecting zone 20, is disposed at the outlet side 13 of the developing machine 6 and receives the developed and dried material adequately conveyed to it. Subsequently, the developed and dried material is to be picked up and passed through the following operative processing units of the plant.

In turn, the collecting storage means 7 and 9 are also provided, as usual, with a plurality of upper and lower rotating rollers, not shown directly in FIG. 1. The rollers can be driven in rotation by at least one associated electric motor providing an adjustable speed output in a conventional manner, not illustrated here. The photographic material is wound around rollers. The rollers provide both, for the transport in the advancement direction A of the photographic material through all the plant operative units and for the temporary storage of the photographic material. The rollers operate in such a manner as to be able to take up an oversupply and excess amount of photographic material coming from the operative unit located directly upstream of the associated collecting storage means, when the unit situated directly downstream of the collecting storage means and referred to is stopped or operates with a decreased advancement speed of the photographic material in order to meet operative requirements of said unit situated downstream. Alternatively, the rollers are provided also to be able to supply said unit situated downstream with photographic material, when this latter unit, situated downstream, operates with considerable accelerations. Moreover, such collecting storage means 7 and 9 are advantageously paired with associated sets of guiding rollers 21 and 22, disposed outside of the collecting storage means 7 and 9 and positioned adequately oriented with respect to the operative unit interposed between the first collecting storage means 7 and the second collecting storage means 9. This permits a suitable insertion and entry and/or exiting and leaving of the photographic material relative to the respective operative unit, without a risk of distortions, disfigurations, jamming and/or breakages of the photographic material.

A first set of guiding rollers 21 is disposed at the inlet side 23 of the quality-control table 8, i.e. between the quality-control table 8 and the outlet side 24 of the first collecting storage means 7 according to FIG. 1. A second set of guiding rollers 22 is disposed at the outlet side 25 of said quality-control table, i.e. between the quality-control table 8 and the inlet side 26 of the second collecting storage means 9.

As usual, the quality-control table 8 is provided for the inspection of the quality of the developed prints of the photosensitive material and of the image printed onto the photographic paper. The cutting equipment 10 is provided for automatically cutting the photographic material, in this case, the photographic paper, to the required size. The display unit 11 permits to display the different plant operative parameters and operational state in a real time display as well as the input of the operating parameters needed to insure a proper operation of the entire plant.

Finally, the first and second adaptation units 12 and 15 according to the present invention are provided for suitably adapting the feed advancement speed of the photographic material between leaving an operational unit and reaching a directly subsequently following operational unit. These feed advance speeds are normally equal to each other and become different owing to the different operative needs and manners of the same operating units, in order to insure a correct and steady advancement of the photographic material among said operating units. Thereby there is avoided any possible danger of undesired distortions, breakages and/or tearings of the photographic material on the transit path between a first operating unit and a second operating units. These adaptation units, which will be described in detail hereinafter, are substantially provided with at least an associated control means shaped as a microprocessor (not shown), connected to the entire electric wiring harness of the whole plant, which interconnects all the operative units and adaptation units of the same plant. Said microprocessor is arranged both to control the correct operation of the respective adaptation unit by means of an information data exchange and by signalling immediately any anomalous operative condition of the respective adaptation unit, such as failure, stop, etc., and to control the operative state of the operating units situated directly upstream and downstream of the adaptation unit referred to, so as to enable or disable the operation of the adaptation unit and the operative units adjacent thereto, depending on an observation of such operative state of said operative units.

Similarly, the remaining plant operative units are also provided with at least a respective control means of the same type, adapted to control the operation of the remaining operating units in the same manner. The respective control means is also connected to the electric wiring harness of such plant together with the associated control means of the other operating and adaptation units.

Furthermore, the control means of all the operating units and adaptation units, besides performing the control functions on the pertaining unit and of the adjacent units, contain the information of all the operative sequences that the remaining plant operating units and adaptation units must perform. This means that each operating unit and adaptation unit is autonomous with respect to the other operating units and adaptation units and, in the case in which an operating unit or an adaptation unit should operate in an anomalous way, for example owing to failures, stops, etc., and thereby disables perhaps one or more units adjacent thereto, then the remaining plant units will continue to operate in an independent way. Thereby, there is always provided and assured an advancement of the photographic material through the plant caused by the units adjacent thereto until the plant stops, wherein the adjacent units in turn are influenced by such a disabled unit. Thanks to the fact that each microprocessor of a unit contains the information of all the plant operative sequences and since there is eliminated such information of the total plant operating sequences therefore, it appears evident that such microprocessor can be connected to those of the remaining plant units through a wiring harness prearranged for a smaller data information exchange and, consequently, the wiring harness can be considerably smaller dimensioned and more simple with respect to those employed for conventional plants of this kind.

Moreover, this wiring harness may be made having smaller overall dimensions and lends itself to be connected in a simple, quick and removable way among the different plant units, where therefore the different plant units may be combined to each other in different and variable numbers and combinations, by making the thus constructed plant also very flexible and reliable depending on the customer's and/or user's needs.

In this way there may also be obtained plants with units different from those described by way of example, by providing always at least two adaptation units 12 and 15, identical to those specified and, possibly, by eliminating also one or more of the collecting storage means, by interposing such adaptation units also directly between a first operating unit and a second operating unit.

Figure 2:
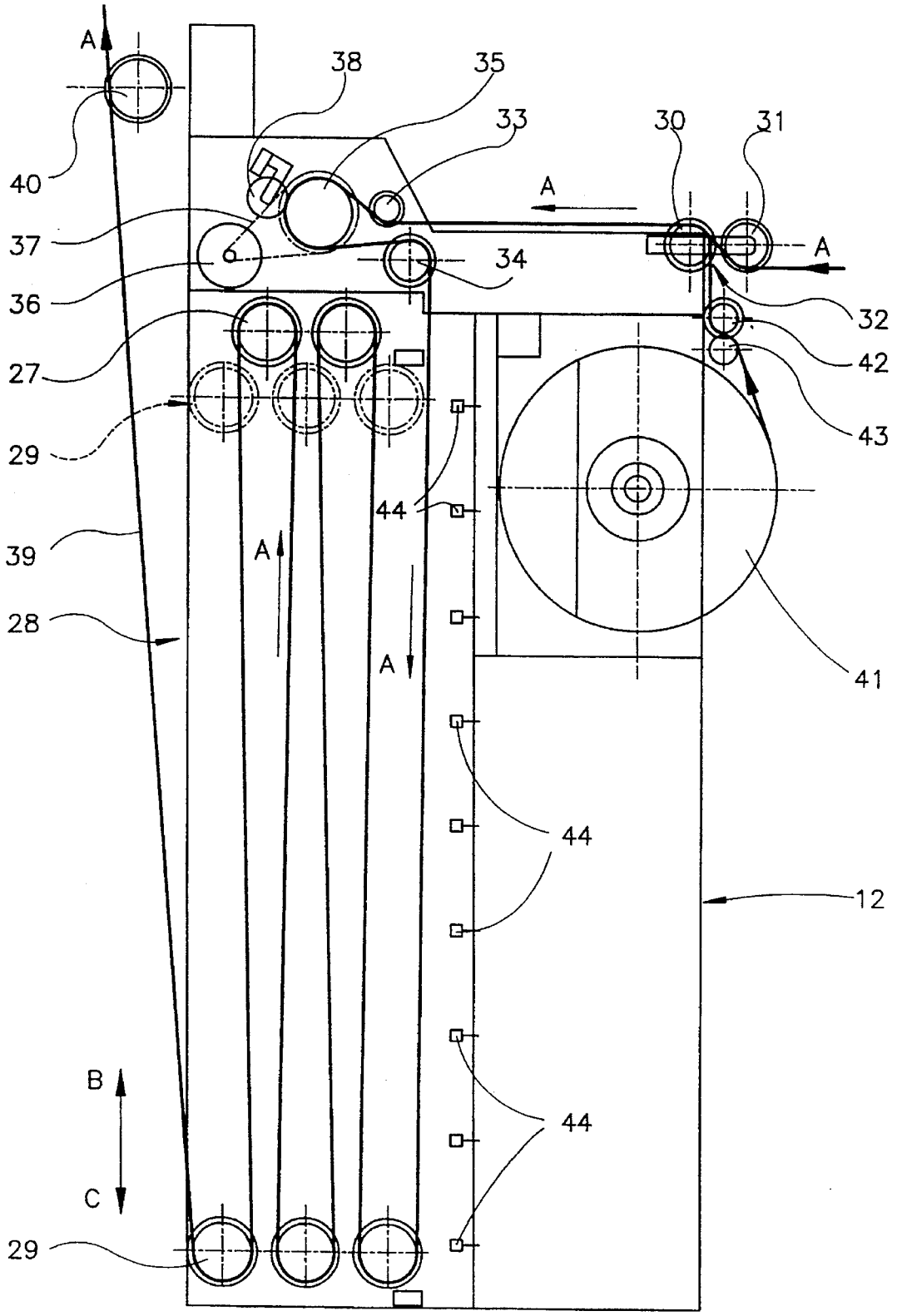
FIG. 2 is a cross-sectional view of a first embodiment of an adaptation unit.
Figure 3:
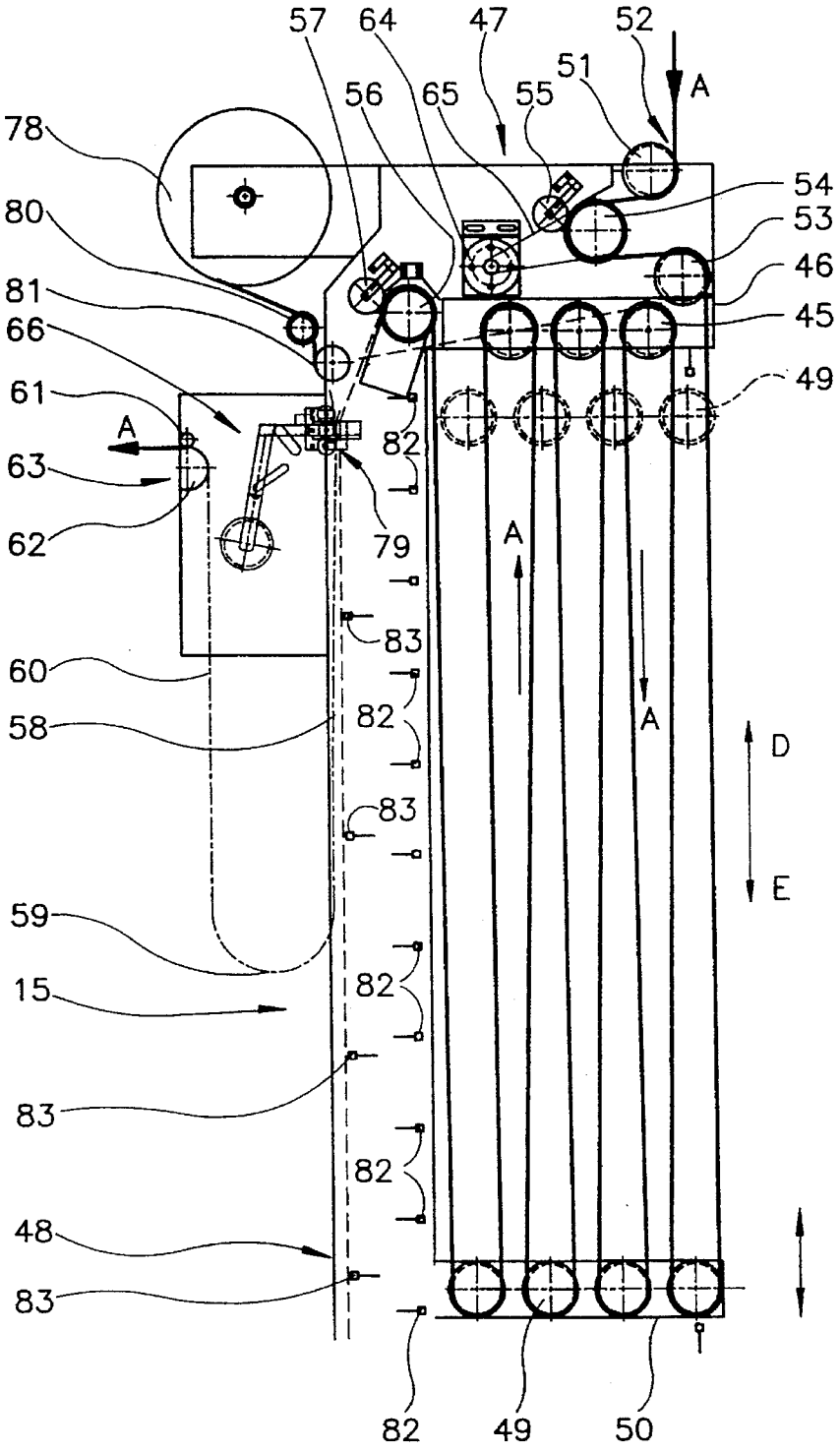
FIG. 3 is a cross-sectional view of a second embodiment of an adaptation unit.

By examining now FIGS. 2 and 3, there are shown schematically the two adaptation units 12 and 15 according to the invention. The first adaptation unit 12 is shown in FIG. 2. In the case of the present plant, this first adaptation unit 12 is disposed between the outlet side 13 of the photographic material developing machine 6, in the present case, of photographic paper, and the inlet side 14 of the first collecting storage means 7. The inlet side 14 is situated on the upper side of such collecting storage means 7. The photographic material is transported in its feed advance direction A from the first adaptation unit 12, into which it is introduced as it will be described later, toward the collecting storage means 7 by means of suitable conveyor devices, not shown in the FIG. 2 and of a conventional construction, interposed between said adaptation unit and said collecting storage means 7.

As is evident from this FIG. 2, the adaptation unit 12 comprises substantially a first set of idle rotating rollers 27, disposed parallel to each other and having a horizontal axis of rotation. The first set of rotating rollers 27 is disposed on the upper side of a box-like envelope 28, transversally thereto, and the rotation axles of the first set of rotating rollers are stationary. The adaptation unit 12 comprises a second set of idle rotating rollers 29, disposed parallel to each other and having a horizontally disposed axis of rotation. The second set of rotating rollers 29 is disposed on the lower side of such box-like envelope, transversally thereto, and the rotation axles of the second set of rotating rollers 29 are movable vertically with respect to the corresponding axles of the upper rollers 27, either in a first one or in a second one of the two directions B or C, from an upper position of end of stroke to a lower position whereby said lower rollers 29 are respectively raised and brought closer to the upper rollers 27, and alternatively lowered and moved away from such upper rollers 27 to provide the greatest distance between the upper rollers 27 and the lower rollers 29.

Furthermore, this adaptation unit 12 comprises additional idle rotating rollers having horizontal axles of rotation, disposed on the upper side of the adaptation unit 12, and above the upper rollers 27. These additional rollers are formed in the present example by two closely neighboring rotating rollers 30 and 31 provided on the inlet side zone 32 of the adaptation unit, and disposed at a position opposite to the outlet side of the developing machine 6 and brought closer with respect to the outlet side 13 of the developing machine 6, not shown in the FIG. 2. A rotating roller 33 is spaced rectilinearly from the preceding pair of rotating rollers 30 and 31 and housed inside the box-like envelope 28. A rotating roller 34 is aligned rectilinearly and perpendicularly with respect to the corresponding lower rollers 29.

A powered rotating roller 35 is additionally situated between the idle rotating rollers 33 and 34. The powered rotating roller 35 can be driven in rotation by its own electric motor 36, having steady or variable torque, by means of through a belt drive 37 or the like. Thereby, a sliding path is provided for the photographic material, which is thus wound around the idle rollers 30, 31, 33, 34 and the powered roller 35. Said rollers cause a suitable tensioning of the photographic material, also thanks to a movable pressing roller 38 co-operating with the powered roller 35 to insure always a correct feed advance in the direction A shown in FIG. 2. Said photographic material is afterwards sequentially wound like a coil over the various upper rollers 27 and lower rollers 29. When leaving the last lower roller 29, the photographic material forms an inclined, upwardly directed portion 39. The photographic material is suitably guided along an inclined portion 39 by an idle roller 40, disposed at the outside of the adaptation unit, and is thus able to arrive at the upper inlet side 14 of the first collecting storage means 7. In addition, the adaptation unit 12 comprises a dispensing roller 41, having a large diameter as compared to the rotating rollers. The dispensing roller 41 is disposed at a position below and coinciding with the photographic material inlet side zone 32 and contains a driving band (leader) wound thereon. Said driving band is adapted to entrain the photographic material through the complete sliding path of the photographic material in the adaptation unit 12 and the following and subsequent plant operating units. Said driving band is guided toward said inlet side zone 32 by means of adequate idle guide rollers 42 and 43 situated between said dispensing roller 41 and said pair of idle rollers 30 and 31.

Finally, the adaptation unit 12 comprises a plurality of sensor means constituted by conventional electronic sensors 44, for example, photodiodes, photocells, etc., electric sensors or else electromechanical sensors of various kinds, connected to the electric circuit of the plant and housed inside the box-like envelope 28, at such positions as to be able to continuously sense the coil shaped sliding path of the photographic material between the sets of upper rollers 27 and lower rollers 29. Advantageously, as in case of the present embodiment, the sensors 44 are arranged reciprocally aligned and vertically equidistantly spaced, and disposed close and parallel to the photographic material. Thereby the sensors 44 are able to sense the presence of the photographic material wound around the lower rollers 29 as a result of the vertical shifting of the lower rollers 29 from the upper position to the lower position of the endstroke, wherein the lower rollers 29 pass through different intermediate positions. The object of this sensing is to determine instantaneously and automatically the quantity of photographic material present or not present in the above coil-shaped path, which photographic material is collected therein or dispensed therefrom in a variable way as a result of different operative conditions of the units, which are situated directly upstream and downstream of the present adaptation unit, thus compensating for the different photographic material and feed advance speeds in the various plant operative units, therefore providing for a correct advancement and tensioning of said photographic material through all the above recited operating units. The microprocessor of the adaptation unit is programmed in advance for this purpose so as to receive coded information of whether photographic material is present or not present according to any one of the sensors 44, and to convert instantaneously such information into defined quantities of photographic material in fact present in the course of the coil-shaped path. Thus, the microprocessor of the adaptation unit can interact adequately with the operative unit situated directly downstream of said adaptation unit, in order to compensate effectively for differences of the photographic material feed advance speeds between an upstream unit and a downstream unit.

In particular, in the considered case, where the microprocessor senses the presence or absence of the photographic material, and thus records a temporary storage capacity of the same material into the collecting storage means, where the containing capacity is determined by such coil-shaped path, wherein the coli-shaped path provides for processing a coded response information corresponding to such temporary containing state. The coded response information is transmitted to the microprocessor of the first collecting storage means 7, which, consequently, provides for control of the driving motor for the rotating rollers of such operating unit and, in the case of an abnormal operation of this operating unit. Then, the information is additionally transmitted to an electric motor 36 for operating the powered roller 35 of said adaptation unit. This allows and results in suitably actuating either a first motor or a second motor, or both motors, in order to distribute properly the photographic material among the various units 12 and 7.

In this way, the microprocessor continuously senses a presence of the photographic material along the entire coil shaped path thereof and, depending on the sensed quantity of photographic material, the microprocessor provides for an adequate control of the rotation of the driving motor for the rotating rollers of the collecting storage means 7. Thus, it is possible to accelerate such rotation for a determined amount of time when a considerable quantity of photographic material within said coil-shaped path is collected, and to transfer the material rapidly into the collecting storage means 7, and consequently to keep steady or to stop such rotation of the respective rollers. Then, the rotation speed can be maintained or, respectively, the rotation can be stopped/depending on the situation present, where the photographic material has been collected at normal quantities, or where the photographic material is completely absent within said coil-shaped path.

Moreover, under these operative conditions the microprocessor keeps the motor 36 of said adaptation unit constantly running, wherein the motor is driven to maintain substantially the same feed advance speed of the photographic material coming from the preceding operating unit (in the case of FIG. 2, the developing machine 6). Conversely, the lower rollers 29 should be raised or lowered relative to the associated upper sensors or lower sensors of the end section under the possible abnormal operation conditions. Thus, the microprocessor can signal such conditions by stopping in such case the rotation of said motor 36.

The just described adaptation unit is also furnished with suitable safety systems, for preventing the photographic material from damage and/or tearing in case of possible operating failures of said adaptation unit. Such safety systems are generally formed by appropriate conventional sensors (not shown here), wherein the sensors are housed within the coil-shaped path of the photographic material, and wherein the sensors are operatively connected to said microprocessor in order to provide for signalling continuously the operative conditions in the adaptation unit to the microprocessor. This way the microprocessor can regulate such operative condition in case of abnormal operation of the adaptation unit and, at the same time, signal these abnormal operations. The safety systems provide for a stopping of the electric motor 36 and for a shutting off of the adaptation unit through the microprocessor, when possible tearing of the material or defective operations of said adaptation unit or the operative unit situated directly upstream or downstream of the adaptation unit do occur. These abnormal conditions are adequately signalled on the plant display unit 11 by the microprocessor, thus allowing for repair of the adaptation unit and by restoring the correct operation to the adaptation unit.

FIG. 3, represents the second adaptation unit 15 according to the invention which in case of the present plant is disposed between the outlet side 16 of the second collecting storage means 9 and the inlet side 17 of the cutting equipment 10. The second adaptation unit 15 is also provided with a control microprocessor of its own (not shown).

As evident from this figure, the adaptation unit 15 comprises substantially, as the preceding unit, a set of idle-rotating rollers 45, parallel to each other and having horizontal axis of rotation, disposed on a horizontal fixed arm 46 positioned transversally on the upper side of a box-like envelope 47, and supported by a vertical column 48 joined to the box-like envelope 47 and resting on the floor. The adaptation unit 15 further comprises another set of idle-rotating rollers 49, disposed parallel to each other and having each a horizontal axis of rotation. In particular, the rollers 49 are disposed on a horizontal arm 50 supported by the vertical column 48, where the horizontal arm 50 is disposed transversally on the bottom side of the box-like envelope 47 and wherein the horizontal arm is movable vertically relative to the upper arm 46 in either one of the two directions D or E, from an/the upper to a lower position of the end section such that said lower rollers are respectively raised and thus brought closer to the upper rollers 45, and then lowered and thus moved away thereby providing the greatest distance between the lower rollers and the upper rollers. In addition, this adaptation unit 15 further comprises idle rotating rollers 51, 53 and 54 having horizontal axles of rotation, and disposed on the upper side of the same unit, above the upper rollers 45. A first idle rotating roller 51 is situated on the inlet side zone 52 of the adaptation unit, at a position suitable to receive the photographic material arriving perpendicularly to the inlet side zone 52 from the upper outlet side 16 of a second collecting storage means 9. A second idle rotating roller 53 is disposed vertically aligned above the lower roller 49, and slightly shifted toward the end of the associated support arm 50 relative to the remaining lower rollers 49. A third idle rotating roller 54 is interposed between the two preceding idle rollers 51 and 53, thereby providing a sliding path for the photographic material being wound around all said idle rotating rollers, which idle rollers produce a suitable tensioning of the photographic material to always provide for a correct advancement thereof in the direction A. Said photographic material is afterwards wound as a coil around the different upper rollers 45, the lower rollers 49 and an upper motor-driven rotating roller 56, which roller 56 co-operates with a movable pressing roller 57 placed side by side to said upper rollers 45 and supported by the same arm 46. Then, the photographic material leaves motor-driven roller by an inclined path section 58 directed downwardly relative to the motor-driven roller and then, after having formed a circular loop 59, directed upwardly through a further inclined path section 60 of the photographic material. The photographic material is finally bent almost orthogonally in the horizontal direction, with a suitable bending radius. Then, the photographic material passes through two idle rotating rollers 61 and 62 positioned close to a mechanical clutch device 63 of a conventional construction, so as to arrive at the inlet side 17 of the cutting equipment 10.

This adaptation unit performs thereby the same compensating functions for the different photographic material feed advance speeds in the various operative units of the plant, in the same way as described for the preceding adaptation unit 12. Furthermore, said adaptation unit can be provided optionally with another electric motor 64, adapted to transmit the rotation by means of driving belt 65 or the like to one of the idle rollers, for example, the roller 54, with the aid of a movable pressing roller 55 for tensioning the photographic material, in order to help the photographic material feed advance through the coil-shaped path of said adaptation unit, when the pull exerted by the weight of the lower roller, 49 is not sufficient to allow a correct feed advance of the photographic material.

In turn, the mechanical clutch device 63 serves to ensure always a correct automatic tensioning of the photographic material, by adapting it to the changes of tension produced in the subsequent operative unit (in this case of FIG. 2, the cutting equipment 10). Advantageously, in case where the present adaptation unit must be positioned upstream of any operative unit which must operate in a continuous way, it is appropriate to provide also a cutting device 66 at the outlet side of said adaptation unit, which cutting device is disposed, for example, on the upper side of the inclined portion 58 of the photographic material path, as evident from FIG. 3, or also at different positions adequate for this purpose. Preferably, also this cutting device is of a mechanical type to permit the cutting of the material in emergency conditions such as a lack of electric energy supply.

Figure 4:
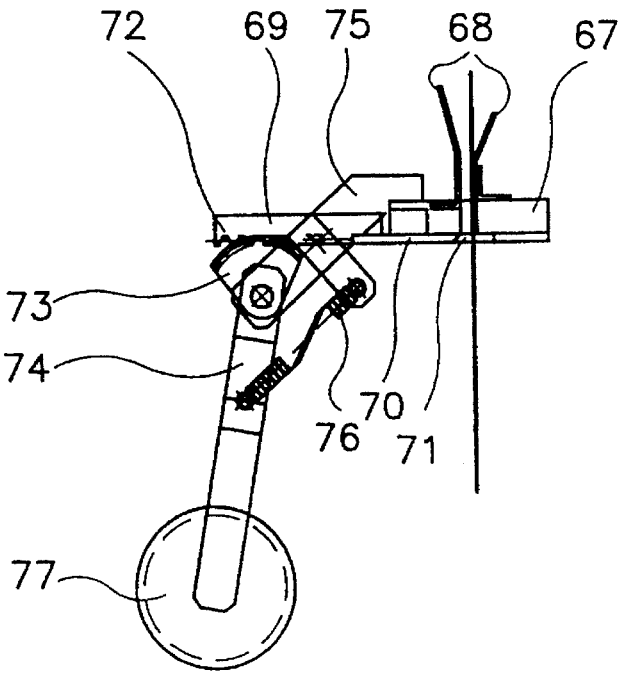
FIG. 4 is an enlarged detail view of the adaptation unit of FIG. 3 in a first operative position.
Figure 5:
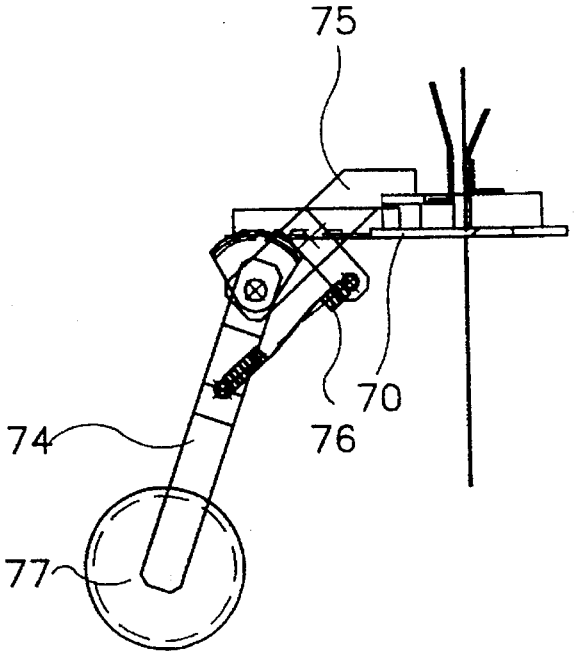
FIG. 5 is an enlarged detail view of the adaptation unit of FIG. 3 in a second operative position.

The cutting device 66 is schematically shown in two different operative positions, respectively, in the rest position, in which the cutting of the photographic material is not performed, and in the operating position, in which the cutting device 66 cuts the photographic material according to FIGS. 4 and 5.

From these FIGS. 4 and 5, it is noted that the cutting device 66 is substantially constructed of a horizontal rectilinear arm 67 fixed at the one end to the vertical column 48 of the adaptation unit 15, and provided with suitable vertical guide elements 68 for passing and guiding the photographic material leaving said adaptation unit and directed toward the subsequent plant operating unit.

Such fixed arm 67 is also associated to a movable arm 69 slidable rectilinearly and horizontally and having a limited stroke length with respect to the fixed arm 67. The movable arm 69 is furnished with a cutting element 70, having a through hole 71 to allow the photographic material to pass therethrough, and with a rack portion 72 at its free end, which rack portion 72 is adapted to engage a correspondent sector gear 73, fixed in an articulated manner and hinged at the end of a further rectilinear arm 74.

This rectilinear arm 74 is supported by the fixed arm 67 by means of an additional arm 75, by which it is articulated and hinged with the sector gear 73. The rectilinear and straight arm 74 is also connected resiliently by means of at least one compression spring 76. The compression spring 76 tends to maintain the arms 74 and 75 continuously pressed against each other at their rest position shown in FIG. 4, wherein the movable arm 69 is moved by the sector gear 73 and the rack portion 72 such that the cutting element 70 is disposed with its through hole 71 aligned with the vertical guide elements 68.

Then, under this operative condition the photographic material can slide freely through said guide elements 68 and said through hole 71 without being reached by the cutting blade of the cutting element 70.

In turn, the rectilinear and straight arm 74 is furnished at its free end with an idle rotating roller 77 adapted to permit a guiding and sliding of the photographic material, in case where an insufficient amount of photographic material is present within the coil-shaped path of said adaptation unit.

Under these conditions of an insufficient quantity of photographic material within said adaptation unit, then, such material winds itself around the rotating roller 77 of the rectilinear arm 74, thereby shifting this latter into its operating position shown in FIG. 5 against the action of the spring 76, in which position said rectilinear arm 74 is rotated to a certain extent relative to the fixed arm 67. This rotation of the rectilinear arm 74 produces a subsequent slight horizontal sliding of the cutting element 70, as a result of the engagement between the sector gear 73 and the rack portion 72, so that the photographic material can be cut by the cutting blade of said cutting element. In addition, said adaptation unit comprises a winding roller 78 of a large diameter situated at a position above and coinciding with the outlet side zone 79 of the photographic material, thus allowing the driving band (leader), arriving from the preceding dispensing roller 41 of the other adaptation unit and passing through all the plant operative units, to entrain the photographic material therewith to be wound onto said roller. Said driving band is guided toward said sliding path of the photographic material by suitable idle guiding rollers 80 and 81 situated between said winding roller 78 and said outlet side zone 79. Finally, the present adaptation unit 15 comprises a plurality of sensors 82 of the same type and for the same control functions as the previously described adaptation unit 12, and positioned in the same manner as the corresponding sensors 44 of the adaptation unit 12, so that it is deemed appropriate not to repeat these features already known from the preceding description.

In addition, this adaptation unit 15 comprises a plurality of additional sensors 83 of the same type, positioned along the vertical column 48 in a way so as to be able to sense constantly the sections 58, 59 and 60 of the sliding path of the photographic material. Advantageously, in case of the present embodiment shown in FIG. 3, the sensors 83 are arranged reciprocally aligned and vertically equidistantly spaced, and disposed close and parallel to the photographic material, so as to be able to sense the presence of photographic material passing through said sliding path, for the same purposes as previously described. Therefore, in this adaptation unit 15 the microprocessor of the adaptation unit 15 is preprogrammed to receive coded information of the presence of photographic material, not only from respective sensors 82, in order to convert the received information into transporting and delivering corresponding quantities of photographic material as previously described, but also as derived from the respective sensors 83, in order to be able to obtain also in this case with the same criteria the quantity of photographic material being collected or not collected within said sliding path of the same material. Thus, said microprocessor can control the motor-driven roller 56 and the possible electric motor 64 of said adaptation unit, as well as the control motor (not shown) of the preceding operative unit (in this case, the collecting storage means 9), with the same operative criteria as previously described to obtain and achieve always the same purposes, i.e. keeping the motor-driven roller 56 and the possible electric motor 64 running, and by driving the motor of the rotating rollers of the collecting storage means 9. Thus, also in this case the sensors may sense the presence or absence of the material at the upper position and at the lower position of the end section, corresponding to abnormal operative conditions for which a corresponding signal is furnished to the display unit 11, with a possible stopping of the motor-driven roller 56 (in case, where the photographic material is sensed within the coil-shaped path), or suitable change of the speed of said motor-driven roller (in case, where the photographic material is sensed in the sliding path sections 58, 59 and 60). Of course, the adaptation unit 15 is also furnished with the same safety systems, which are housed and operate with the same criteria as previously described.

Therefore, in a plant for continuous development of photographic material comprising adaptation units of this kind, the photographic material arriving from an operative unit of the plant (in this case, the developing machine 6) is first joined to an adequate driving band, previously introduced along the sliding path of the photographic material through all the adaptation units and operative units of the plant. Then, the driving band is unwound from the dispensing roller 41 of the adaptation unit 12 and wound around the winding roller 78 of the adaptation unit 15.

In this way, also the photographic material is inserted and guided along all the sliding path thereof for performing the desired and expected treatment operations, while, in turn, the driving band is wound completely onto such winding roller 78, which roller 78 is then removed from its seat and assembled again onto the first adaptation unit 12, in place of the previously emptied roller 41 now assembled onto the second adaptation unit 15, for performing the function of winding roller. Then, said driving band is joined to the end of the last photographic material to be treated in the plant, for a subsequent winding of the photographic material around the winding roller in order to repeat the described cycle.

The thus-obtained adaptation units permit to combine in a flexible manner various operative units to each other in one plant for developing photographic material, which units thus can be arranged more rationally also within limited spaces of installation. This also allows for a continuous and quick compensation of the different feed advance speeds of such photographic material through the plant, without danger of distortion and/or tearing of the photographic material.

Moreover, thanks to the installation of independent control means, such as the microprocessors, the adaptations units and the remaining operative units of said plant can operate independently of each other, thereby eliminating a necessity of stopping the entire plant in case of a possible operational failure of one or more of said units.

It will be understood that each of the elements described above, or two or more together, may also find a useful application in other types of adaptation units for material advancement differing from the types described above.

While the invention has been illustrated and described as embodied in the context of an adaptation unit for advancement of photographic material for a plant for continuous development of photographic material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A photographic material advancement adaptation unit for a plant for continuous development of photographic material, said plant comprising a plurality of operating units of a conventional type selected from the group consisting of developing machine, collecting storage means, quality-control table, cutting equipment, and combinations thereof, which operating units are combinable with each other in different manners, such that a photographic material is passable for treating of the photographic material through the plurality of operating units;

a plurality of adaptation units, wherein each of the plurality of adaptation units is disposed between two otherwise neighboring operating units of the plurality of operating units, said adaptation units comprising guide means shaped as rotating rollers for passing the photographic material and at least a driving band leader for entraining the photographic material therethrough, wherein the plurality of adaptation units includes a first adaptation unit and a second adaptation unit, wherein the first adaptation unit and the second adaptation unit are autonomous and separated as well as removably interposable between two operating units which are consecutive to each other and wherein the first adaptation unit and the second adaptation unit comprise temporary collecting means, shaped as stationary upper rollers and movable lower rollers, for winding the photographic material thereon, adapted to compensate for changes in advancement speed of the photographic material through the different plant units, by means of a succession of storing and dispensing of such photographic material between the first adaptation unit and the second adaptation unit;

at least a display unit of a conventional type connected to the plurality of operating units and to the plurality of adaptation units for aiding in controlling and inspecting operation of said operating units and of said adaptation units;

a plurality of powered means, wherein each of the powered means is associated with one of said operating units and said adaptation units to provide for advancing the photographic material;

a plurality of control means connected independently relative to each other, and wherein each one of the plurality of control means is connected to the plurality of operating units and connected to the plurality of adaptation units for controlling the operation of the respective operating units and of the respective adaptation units in accordance with preestablished operating cycles and depending on the operational state of the other operating units and adaptation units disposed directly adjacent to a respective one of the plurality of operating units and of the plurality of adaptation units;

first sensor means provided to said first adaptation unit and adapted to sense as coded information the quantity of photographic material which is provided from time to time within said temporary collecting means, wherein said first sensor means is controlled by said control means associated with the first adaptation unit in such a way as to influence a predetermined first powered means of the plurality of powered means of the operating unit preceding the first adaptation unit and a predetermined second powered means of the plurality of powered means of the operating unit following to the first adaptation unit in a way to change or stop a rotation of the powered means of the first adaptation unit depending on the photographic material being provided within the first adaptation unit;

second sensor means provided to said second adaptation unit adapted to sense as coded information the quantity of photographic material which is provided from time to time within said temporary collecting means, wherein said second sensor means is controlled by said control means associated with the second adaptation unit in such a way as to influence a predetermined third powered means of the plurality of powered means of the operating unit preceding the second adaptation unit and of a predetermined fourth powered means of the plurality of powered means of the operating unit following to the second adaptation unit in a way to change or stop a rotation of the powered means of the second adaptation unit depending on the photographic material being provided within the second adaptation unit.

2. The adaptation unit according to claim 1, wherein the first sensor means provided to said first adaptation unit is adapted to sense as coded information the quantity of photographic material, which is provided from time to time within said temporary collecting means, wherein said first sensor means is controlled by said control means associated with the first adaptation unit in such a way as to influence said powered means in a way to change and stop, respectively, a rotation of the powered means of the first adaptation unit depending on the photographic material being provided within the first adaptation unit; second sensor means provided to said second adaptation unit is adapted to sense as coded information the quantity of photographic material which is provided from time to time within said temporary collecting means, wherein said second sensor means is controlled by said control means associated with the second adaptation unit in such a way as to influence said powered means of the first adaptation unit in a way to change and stop, respectively, a rotation of the powered means of the second adaptation unit depending on the photographic material being provided within the second adaptation unit.

3. The adaptation unit according to claim 1, wherein the first sensor means comprise a plurality of electronic, electric, electromechanical or similar sensors of a conventional type, connected operatively to said control means associated with the first adaptation unit and adapted to sense a presence of the photographic material or to sense an absence of the photographic material along a sliding path of the adaptation unit, up to an upper and a lower position of an end of section thereof, which sensing furnishes a signal, and wherein the signal is delivered through said display unit, and wherein the delivered signal alerts to conditions corresponding to anomalous operative conditions of said first adaptation unit.

4. The adaptation unit according to claim 3, wherein said first adaptation unit comprises a dispensing roller and wherein said second adaptation unit comprises a winding roller for a driving band leader, arranged removably and corresponding to the sliding path for the photographic material, to allow said driving band leader to pass from said dispensing roller to said winding roller and vice versa.

5. The adaptation unit according to claim 4, wherein said second adaptation unit comprises clutch means of a conventional type, to keep the photographic material leaving the second adaptation unit substantially steadily tensioned prior to an arrival of the photographic material in a subsequent operating unit, and final cutting means disposed between an outlet side of the second adaptation unit and said clutch means for cutting the photographic material at appropriate intervals.

6. The adaptation unit according to claim 5, wherein said cutting means comprise a first rectilinear arm fixed to said second adaptation unit, a second movable arm cooperating with said fixed first rectilinear arm and provided with at least a cutting element adapted to cut the photographic material, a third rectilinear arm provided at a first end of the third rectilinear arm with at least an idle rotating roller for sliding and guiding the photographic material, in case of scarcity of photographic material within said second adaptation unit, a fourth arm fixed with a first end of the fourth arm to said first arm, wherein said third arm is being articulated at its second end with the fourth arm and is Joined to said fourth arm by spring means adapted to keep said third arm and said fourth arm pushed relative toward each other, wherein the third arm is provided at the second end with first driving means engaging second driving means provided on said second movable arm, wherein said third arm is adapted to shift said second movable arm together with said cutting element, by means of said first driving means and said second driving means, from a first rest position, in which said cutting element does not affect the photographic material passing through a corresponding through hole of said cutting element, to a second operating position in which said cutting element affects the photographic material, by cutting it, in presence of a scarce quantity of photographic material within said second adaptation unit.

7. A photographic material advancement adaptation unit for a plant for continuous development of photographic material to be disposed between a first operating unit and a second operating unit, comprising a first adaptation unit including first guide means shaped as rotating rollers for passing the photographic material and at least a driving band leader for entraining the photographic material therethrough;

a second adaptation unit including second guide means shaped as rotating rollers for passing the photographic material and at least a driving band leader for entraining the photographic material therethrough;

temporary collecting means shaped as stationary upper rollers and movable lower rollers, for winding the photographic material thereon, adapted to compensate the changes of advancement speed of the photographic material through different plant units, by means of a succession of storing and dispensing such photographic material between the first adaptation unit and the second adaptation unit;

at least a display unit of a conventional type connected to the adaptation unit for aiding in controlling and inspecting the operation of said adaptation unit;

a powered means, wherein the powered means is associated with said adaptation unit to provide for advancing the photographic material;

control means connected to the adaptation unit for controlling the operation of the adaptation unit in accordance with preestablished operating cycles and depending on the operational state of the first operating unit and of the second operating unit disposed directly adjacent to the adaptation unit;

first sensor means provided to said adaptation unit adapted to sense as coded information the quantity of photographic material which is provided from time to time within said temporary collecting means, wherein said first sensor means is controlled by said control means associated with the adaptation unit in such a way as to influence a first powered means of the first operating unit preceding the adaptation unit and a second powered means of the second operating unit following to the adaptation unit in a way to change or stop a rotation of the powered means of the adaptation unit depending on the photographic material being provided within the adaptation unit.

8. The adaptation unit according to claim 7, wherein the sensor means provided to said adaptation unit is adapted to sense as coded information the quantity of photographic material which is provided from time to time within said temporary collecting means, wherein said sensor means is controlled by said control means associated with the adaptation unit in such a way as to influence in a way to change and stop, respectively, a rotation of the powered means of the adaptation unit depending on the photographic material being provided within the adaptation unit.

9. The adaptation unit according to claim 7, wherein the sensor means comprise a plurality of electronic, electric, electromechanical or similar sensors of a conventional type, connected operatively to said control means associated with the adaptation unit and adapted to sense a presence of the photographic material and to sense an absence of the photographic material along a sliding path of the adaptation unit, up to an upper and a lower position of an end of section thereof, which sensing furnishes a signal, and wherein the signal is delivered through said display unit, and wherein the delivered signal alerts to conditions corresponding to anomalous operative conditions of said adaptation unit.

10. The adaptation unit according to claim 9, wherein said adaptation unit comprises further a dispensing roller and wherein said second adaptation unit comprises a winding roller for a driving band leader, arranged removably and corresponding to the sliding path for the photographic material, to allow said driving band leader to pass from said dispensing roller to said winding roller and vice versa.

11. The adaptation unit according to claim 10, wherein said second adaptation unit comprises clutch means of a conventional type, to keep the photographic material leaving the adaptation unit substantially steadily tensioned prior to an arrival of the photographic material on a subsequent operating unit, and final cutting means disposed between an outlet side of the adaptation unit and said clutch means for cutting the photographic material at appropriate intervals.

12. The adaptation unit according to claim 11, wherein said cutting means comprise a first rectilinear arm fixed to said first adaptation unit, a second movable arm cooperating with said first fixed arm and provided with at least a cutting element adapted to cut the photographic material, a third rectilinear arm provided at a first end of the third rectilinear arm with at least an idle rotating roller for sliding and guiding the photographic material, in case of scarcity of photographic material within said second adaptation unit, a fourth arm fixed with a first end of the fourth arm to said first arm, wherein said third arm is articulated at its second end with the fourth arm and is joined to said fourth arm by spring means adapted to keep said third arm and said fourth arm pushed relative toward each other, wherein the third arm is provided at the second end with first driving means engaging second driving means provided on said second movable arm, wherein said third arm is adapted to shift said second movable arm together with said cutting element, by means of said first driving means and said second driving means, from a first rest position in which said cutting element does not affect the photographic material passing through a correspondent through hole of said cutting element, to a second operating position in which said cutting element affects the photographic material, by cutting it, in presence of a scarce quantity of photographic material within said second adaptation unit.

13. Photographic material advancement adaptation unit for a plant for continuous development of photographic material, comprising a plurality of operating units of a conventional type including a developing machine (6), collecting storage means (7, 9), a quality checking table (8), cutting equipment (10), which can be combined with each other in different manners, through which the photographic material is passed for the treatment thereof, as well as comprising at least a display unit (11) of a conventional type for aiding in controlling and inspecting the operation of said operating units (6; 7, 9; 8, 10) and adaptation units (12, 15), said operating units (6; 7, 9; 8, 10) and said adaptation units (12, 15) being provided with powered means (35; 56, 64) to provide for the photographic material advancement and control means, such as a microprocessor, which are independent of each other, predisposed to control the operation of the respective units in accordance with preestablished operating cycles and depending on the operational state of the other operating units and adaptation units directly adjacent thereto, said adaptation units (12, 15) comprising guide means (30, 31, 33, 35, 34; 51, 54, 53) shaped as rotating rollers for passing the photographic material and at least a driving band leader for entraining the photographic material therethrough, and temporary collecting means (27, 29; 45, 49) shaped as stationary upper rollers and movable lower rollers, for winding the photographic material thereon, adapted to compensate the changes of the photographic material advancement speed through the different plant units, by means of a succession of storages and dispensing of such photographic material between the first adaptation unit and the second adaptation unit, characterized by at least a first and a second adaptation unit (12, 15), autonomous and separated as well as removably interposable between two operating units which are disposed consecutive to each other (6, 7; 9, 10), said first and second adaptation units (12, 15) being provided with sensor means (44; 82, 83) adapted to sense as coded information the quantity of photographic material which is provided from time to time within said temporary collecting means (27, 29; 45, 49), said sensor means (44; 82, 83) being controlled by said control means in such a way as to influence said powered means respectively adjacent thereto, and in case also said powered means (35; 56, 64) of the adaptation units (12, 15), in a way to change or stop the rotation of the same powered means depending on the photographic material being provided within the respective adaptation unit.

14. Adaptation unit according to claim 13, characterized in that said sensor means (44; 82, 83) comprise a plurality of electronic, electric, electromechanical or similar sensors of a conventional type, connected operatively to said control means and adapted to sense a presence of the photographic material or to sense an absence of the photographic material along its sliding path, up to an upper and a lower position of an end of section thereof, which sensing resulting in a signal wherein the signal is signalled through said display unit (11), and corresponding to anomalous operative conditions of said first and second adaptation units (12, 15).

15. Adaptation unit according to claim 14, characterized in that said first and second adaptation units (12, 15) comprise respectively at least a dispensing roller (41) and a winding roller (78) for the driving band, arranged removably and corresponding to the sliding path for the photographic material, to allow said driving band to pass from the one to the other one of said dispensing roller (41) and said winding roller (78).

16. Adaptation unit according to claim 15, characterized in that said second adaptation unit (15) comprises a clutch means (63) of a conventional type, to keep the tension of the photographic material leaving the same unit substantially steady, before the photographic material arrives on a subsequent operating unit, as well as cutting means (66), disposed between the unit outlet side (79) and said clutch means (63), for cutting the photographic material at appropriate intervals.

17. Adaptation unit according to claim 16, characterized in that said cutting means (66) comprise a first rectilinear arm (67) fixed to said second adaptation unit (15), a second movable arm (69) cooperating with said first fixed arm (67) and provided with at least a cutting element (70) adapted to cut the photographic material as well as comprise a third rectilinear arm (74), provided at an end thereof with at least an idle rotating roller (77) for sliding and guiding the photographic material, in case of scarcity of photographic material within said second adaptation unit (15), said third arm (74) being articulated at its other end with a fourth arm (75) fixed to said first arm (67), and joined to said fourth arm (75) by spring means (76) adapted to keep said arms (74, 75) pushed the one toward the other one, as well as being provided at its other end with driving means (73) engaging correspondent driving means (72) provided on said second movable arm (69), said third arm (74) being adapted to shift said second movable arm (69) together with said cutting element (70), by means of said driving means (73, 72), from a first rest position in which said cutting element (70) does not affect the photographic material passing through a correspondent through hole (71) thereof, to a second operating position in which said cutting element (70) affects the photographic material, by cutting it, in presence of a scarce quantity of photographic material within said second adaptation unit (15).

18. A photographic material advancement adaptation units for a plant for continuous development of photographic material, said plant comprising a plurality of operating units of a conventional type including a developing machine, collecting storage means, a quality checking table, cutting equipment, which can be combined to each other in different manners, through which the photographic material is passed for the treatment thereof, said plant further comprising a display unit of a conventional type for aiding in controlling and inspecting the operation of said operating units and said adaptation units, control means, such as a microprocessor, which are independent of each other, predisposed to control the operation of respective units in accordance with preestablished operating cycles and depending on the operational state of other operating units and adaptation units directly adjacent thereto, said adaptation units comprising a first adaptation unit and a second adaptation unit each comprising a box-like envelope;

guide means disposed in the box-like envelope and shaped as rotating rollers for providing a sliding path of the photographic material;

temporary collecting means being in the sliding path of the photographic material and including a first stationary set of idle rotating rollers disposed parallel to each other and having horizontal axes of rotation and a second set of idle rotating rollers disposed parallel to each other and having horizontal axes of rotation for winding the photographic material thereon, adapted to compensate changes of photographic material advancement speed through different plant units, by means of a succession of storages and dispensing of such photographic material between two operating units which are disposed consecutive to each other wherein the first set of idle rotating rollers is disposed stationary in an upper side of the box-like envelope and wherein the second set of idle rotating rollers is disposed movably on the lower side of the box-like envelope from an upper position being closest to the first set of idle rotating rollers to a lower position being in a greatest distance between the first set of idle rotating rollers and the second set of idle rotating rollers;

adaptation unit powered means disposed at the box-like envelope for providing a correct feed advance of the photographic material;

sensor means housed inside the box-like envelope and disposed close and parallel to the photographic material and adapted to determine quantity of the photographic material as a result of vertical shifting of the second set of idle rotating rollers from the upper position of the second set of idle rotating rollers to the lower position of the second set of idle rotating set, said sensor means being controlled by said control means in such a way as to influence said powered means respectively adjacent thereto; and a driving band leader for entraining the photographic material through the sliding path of the first adaptation unit, respective operating unit of the plant for continuous development of photographic material and of the second adaptation unit.

19. The photographic material advancement adaptation units for a plant for continuous development of photographic material according to claim 18, wherein the first adaptation unit further comprises a dispensing roller disposed at a position coinciding with a photographic material inlet side zone of the first adaptation unit and containing the driving band leader wound on the dispensing roller, and wherein the second adaptation unit further comprises a winding roller situated at a position coinciding with a photographic material outlet zone of the second adaptation unit to be wound onto the winding roller.

* * * * *